US005181533A

United States Patent [19]

Kooi

[11] Patent Number: 5,181,533

[45] Date of Patent: Jan. 26, 1993

[54] CONTROLLED DISPENSER

[76] Inventor: Rick F. Kooi, 11802 Bexhill, Houston, Tex. 77065

[21] Appl. No.: 790,187

[22] Filed: Nov. 8, 1991

[51] Int. Cl.[5] ..... B05B 7/26; B01F 1/00

[52] U.S. Cl. ..... 137/268; 422/275; 422/276

[58] Field of Search ..... 137/268; 422/261, 268, 422/275, 276, 277, 282; 239/310, 316, 317

[56] References Cited

U.S. PATENT DOCUMENTS

| | | | |
|---|---|---|---|
| 1,321,586 | 11/1919 | Bachman | 137/268 X |
| 1,904,428 | 4/1933 | Enemark . | |
| 3,199,957 | 8/1965 | Vivion | 137/268 X |
| 3,343,918 | 9/1967 | Moulder . | |
| 3,933,308 | 1/1976 | Bradley et al. . | |
| 4,340,179 | 7/1982 | Knapp . | |

*Primary Examiner*—Alan Cohan
*Attorney, Agent, or Firm*—Richard C. Litman

[57] ABSTRACT

A controllable dispenser which dispenses an aqueous solution of a soluble substance. The dispenser has an inlet to accept a supply of water and an outlet to discharge the solution. The dispenser includes a container having a chamber, where the soluble substance is placed, and a passage surrounding the chamber. The chamber is longitudinally in line with the inlet and outlet. The water entering the device is able to flow through both the chamber and the passage. The fluid flowing through the passage functions as a carrier of the solution to the outlet. The chamber is defined at both ends by an orifice. Various chambers may be used, each having a different diameter and different size orifices, one allowing a greater rate of flow than another, thereby increasing the level of concentration or the rate of solubility. The device is preferably constructed of a transparent material which enables the user to observe the amount of soluble substance remaining in the chamber. The apparatus may be used with soluble substances such as fertilizers or pesticides in various forms including granules, pellets, and plugs.

5 Claims, 3 Drawing Sheets

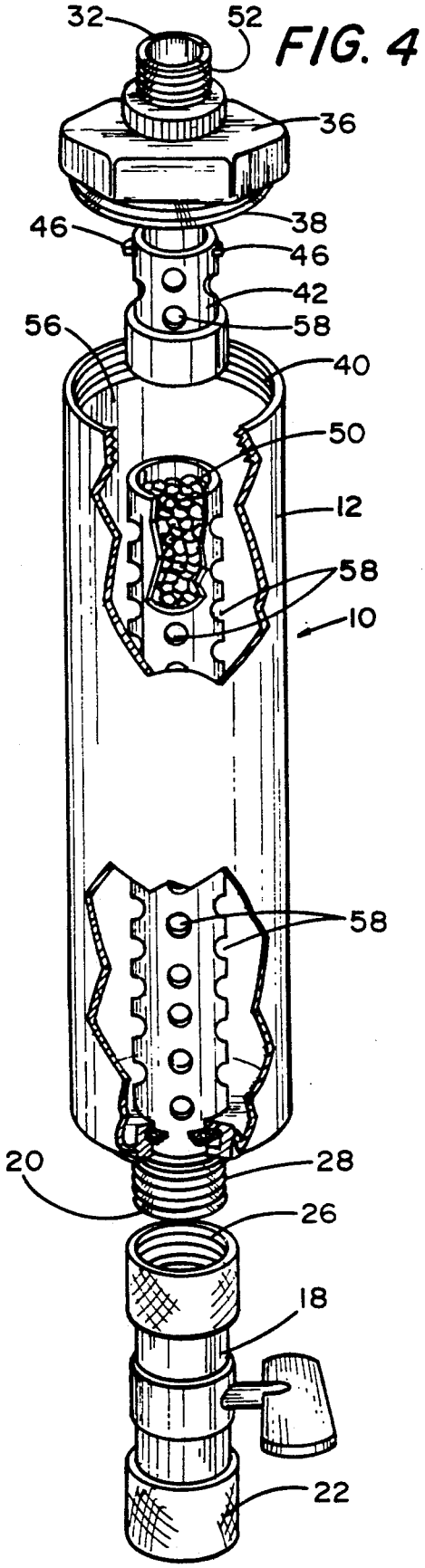
FIG. 4
FIG. 5
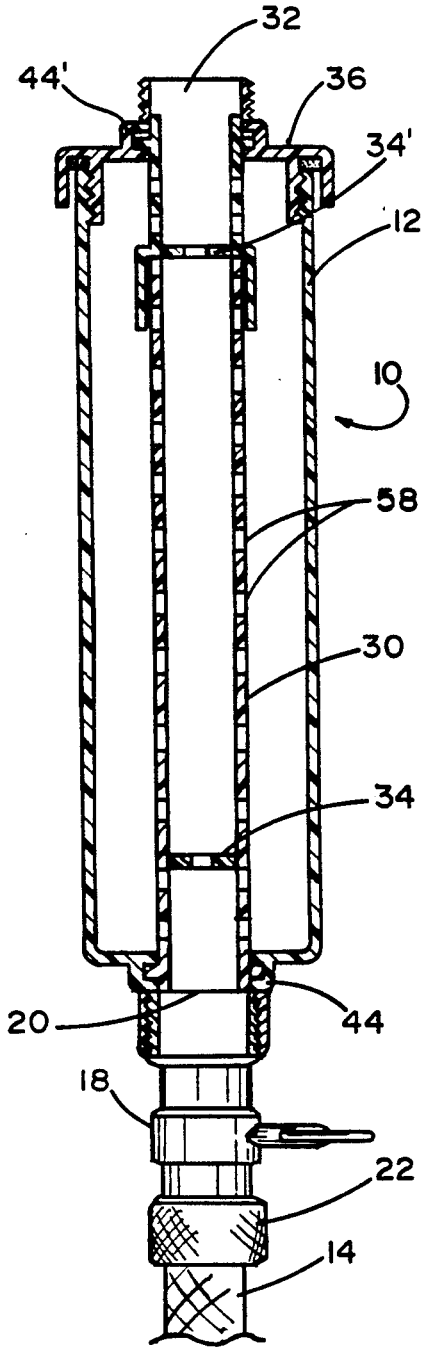

FIG. 6
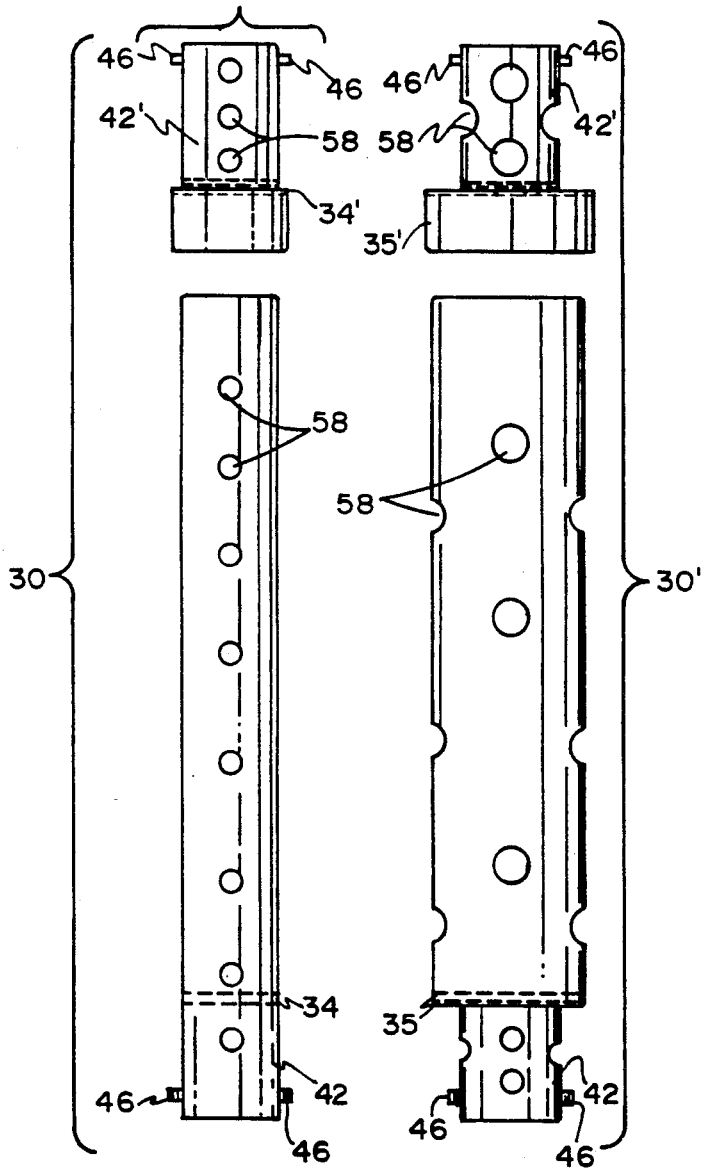
FIG. 7
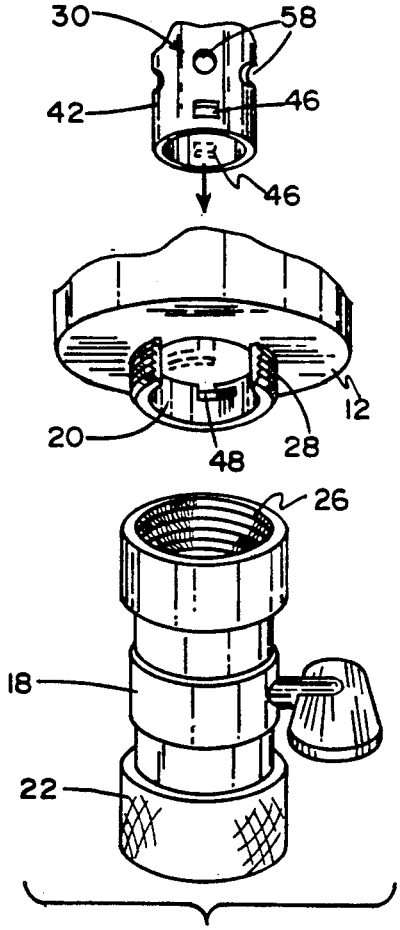
FIG. 3

CONTROLLED DISPENSER

BACKGROUND OF THE INVENTION

1. Field of the Invention

The present invention relates to a dispensing device which dissolves solubles and discharges a controllable amount of aqueous solution of a soluble substance, such as fertilizers or pesticides.

2. Description of Related Art

Presently, the most predominant method of spreading lawn chemicals is with the use of a spreader which sifts and discharges the chemical uniformly over a certain area. The user directs the spreader in a path forming rows, each successive row slightly overlapping the previous row. This is usually a timely process. In some cases, it may be difficult for the user to determine where one row overlaps the other, thus making it difficult to uniformly spread the chemical substance over the area as a whole. In addition, chemicals usually come in a powder or granular form and as a result may be inconvenient or messy to handle. Further, spreaders can be expensive and are typically constructed of metal parts which are subject to corrosion and are inconvenient to store.

Dissolving dispensers are in existence today which have applications related to but not limited to dissolving and discharging soluble lawn and garden chemical products. U.S. Pat. No. 1,904,428 to ENEMARK (issued Apr. 18, 1933) is a container which has a rotatable valve that enables the user to select one of a variety of chambers in whole or in part. Each chamber may contain a different chemical substance or no chemical substance at all. The water flows solely through the chamber selected. This structural arrangement limits the control over the level of the concentration of the solution being discharged.

U.S. Pat. No. 3,343,918 to MOULDER (issued Sep. 26, 1967) is a dissolver container which is placed in line with a water source and a discharge device. This dissolver has a tubular section in line with the inlet port and the outlet port. The tubular section is surrounded by an annular chamber where the soluble substance is placed. This device, because of its construction, directs the flow of the water through the central tubular section, offering no apparent turbulence or means to deflect the water into and the solution out of the annular chamber containing the soluble substance, thus limiting the control of the concentration of the solution.

U.S. Pat. No. 3,933,308 to BRADLEY et. al. (issued Jan. 20, 1976) is a device having a spherical chamber which holds the soluble substance. The chamber can be refilled by removing a cap located at the top of the sphere. Also located at the top of the sphere is a rotating sprinkler head which discharges the solution over a given area dependent on the pressure of the water source. The inlet port is constructed to create a turbulence in the sphere whereby increasing the rate of solubility. This device, having a sprinkler head attached to the outlet, is limited in its application. The user may desire to use a discharge device other than a sprinkler, such as a nozzle.

U.S. Pat. No. 4,340,179 to KNAPP (issued Jul. 20, 1982) is a transparent container which may be placed in line with a water source and a discharge device, such as a sprinkler. This device, however, requires the use of a cartridge which contains a soluble gel and a dye. The dye functions to indicate when the cartridge has expired. This cartridge may be costly and may not be as readily available to the user as the chemicals in their generic form.

Though the most common method of spreading lawn chemicals is with the use of a mechanical spreader, products are available which dissolve the chemicals and discharge an aqueous solution through some discharge means, such as a sprinkler. The products available, however, offer substantially limited control over the concentration of the solution discharged. Moreover, the products offer little control of the source of water entering the inlet opening. Some are limited by the soluble substance which can be accommodated, such as the requirement of a cartridge which may be costly or may not be as readily available as chemicals in their most common form. Structural limitations may not permit the user to easily inspect the amount of soluble substance remaining to be discharged or may limit the products use, such as for sprinkling only.

It is, therefore, one of the objects of the present invention to provide a dispenser which offers control over the level of concentration of the discharged solution.

Accordingly, it is another object of the present invention to provide a dispenser that will enable the user to use a variety of soluble substances in various forms.

It is still another object of the present invention to provide the user with a means to monitor the charge of soluble substance by physically observing the soluble substance remaining in the chamber through the transparent construction of the device.

It is further an object of the present invention to enable the user, by means of a control valve located adjacent the inlet opening, to decrease or stop the flow of water entering the device through the inlet opening, thereby easing the effort in refilling the chamber.

THE SUMMARY OF THE INVENTION

The above objects are accomplished in accordance with the present invention which provides an apparatus for dissolving soluble substances and discharging a controlled concentration of solution.

The apparatus includes a container having an inlet and an outlet. The container is comprised of centralized perforated chamber, surrounded by a passage, longitudinally in line with the inlet and outlet. The central chamber holds the soluble substance. Located adjacent to both ends of the chamber are orifices. The chamber is interchangeable with other chambers, each chamber being a different diameter and having a different size set of orifices, which enables the user to control the concentration of the solution. The apparatus is preferably constructed of a transparent material to permit the user to visually inspect through the transparent device the content of the chamber.

The foregoing and other features, advantages and other objects of the invention may be more fully appreciated by the reference to the following detailed description and drawings.

BRIEF DESCRIPTION OF THE DRAWINGS

FIG. 3 is an elongated exploded view of the twist-lock connection and the alignment of the radial perforations of the present invention.

FIG. 4 is an elongated elevational partially broken view of the present invention.

FIG. 5 is an elongated cross-sectional environmental view illustrating the flow of the fluid through the present invention.

FIG. 6 is an elongated view of the chamber of the preferred embodiment of the present invention.

FIG. 7 is an elongated view of the chamber of an alternative embodiment of the present invention.

Similar reference characters designate corresponding parts throughout the several figures of the drawings.

DESCRIPTION OF THE PREFERRED EMBODIMENT(S)

Figure 1:
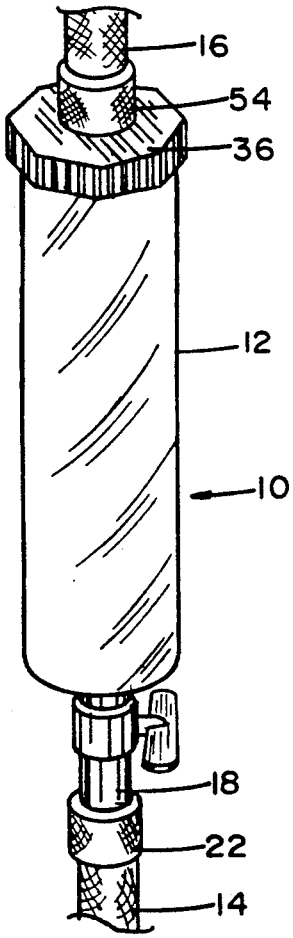
FIG. 1 is an elongated elevational view of the controllable dispensing device according to the present invention.

Referring to the drawing, particularly FIG. 1, the controlled dispenser 10 is comprised of a container 12 which is connected in line with a water source 14 and a discharge device 16.

Figure 2:
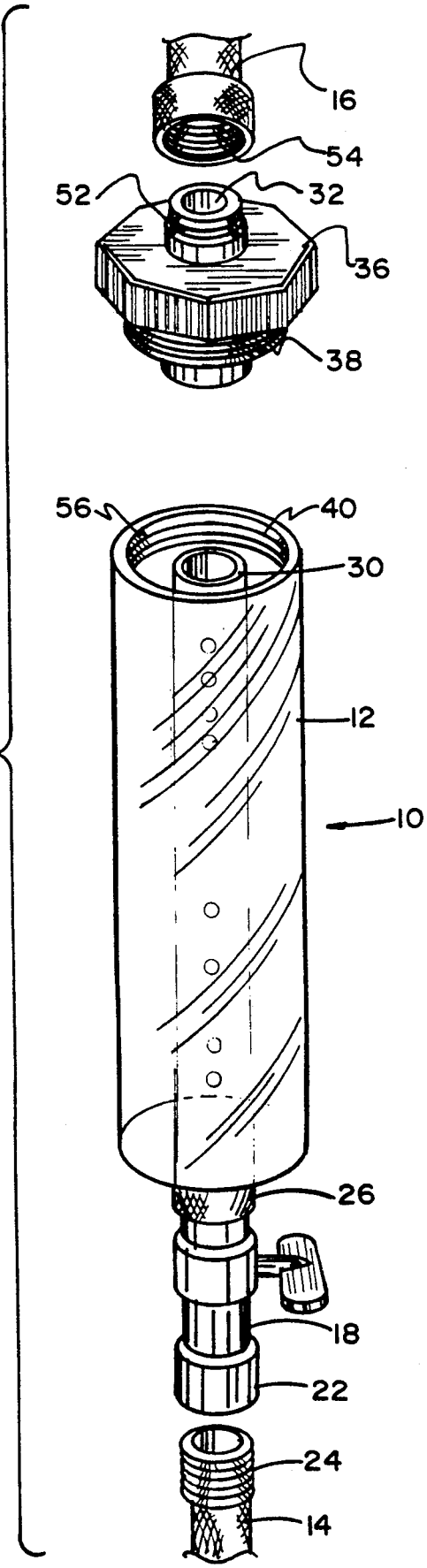
FIG. 2 is an elongated elevational exploded view of the present invention.

Referring to FIG. 2, the controlled dispenser 10 comprised of a container 12, having a valve body 18 adjacent to the inlet opening 20 (shown in FIG. 3). The valve body 18 controls the water entering the container 12 from the source 14. One end of the valve body 18 has a female thread 22 which mates with a male thread 24 of the water source 14. It should be understood that the male and female threaded parts can be interchanged without effecting the functionality of the device. The other end of the valve body 18 has a female thread 26 which mates with the male thread 28 (shown in FIG. 4) adjacent the inlet opening 20 of the container 12.

According to FIG. 2 and FIG. 4, the dispenser 10 has a centrally disposed perforated chamber 30 within the container 12. The chamber longitudinally communicates with the inlet opening 20 and outlet opening 32. The chamber 30 is defined at each end by an orifice 34,34', one orifice 34 adjacent the inlet opening 20 and one orifice 34' adjacent the outlet opening 32 (shown in FIG. 5). The chamber 30 may be accessed by removing the cap 36 from the container 12. The male threads 38 of the cap 36 mate with the female threads 40 of the container 12.

Referring to FIG. 6 and FIG. 7, the chamber 30 is interchangeable with at least one other chamber 30' having a different diameter and a different size set of orifices 34,34' which offer varying restriction to the fluid flow, thus providing control over the concentration of the solution discharged. The chamber 30,30' has a twist-lock male connector 42,42' at each end. A female twist-lock connector 44 appears adjacent the inlet opening 20 of the container 12 which mates with the male twist-lock connector 42 of the inlet opening 20 end of the chamber 30,30'. A female twist-lock connector 44' also appears adjacent the outlet opening 32 of within the cap 36 which mates with the male twist-lock connector 42' of the outlet opening 32 end of the chamber 30,30'. The male and female connectors 42,42' and 44,44' have protrusions 46 and recesses 48 which interlock when twisted together (shown in FIG. 3, FIG. 4, and FIG. 5). The chamber 30,30' is separable into two parts so that it may be filled with a soluble substance 50.

The chamber 30,30' holds the soluble substance 50 as shown in FIG. 4. The container 12 and the chamber 30,30' are both preferably made of a transparent material. This enables the user to visually inspect the content of the chamber 30 without opening the container 12.

The container 12 has an outlet opening 32 on the cap 36. The outlet opening 32 has a male threaded portion 52 to mate with the female threaded portion 54 of the discharge device 16.

Referring to FIG. 4 and FIG. 5, the chamber 30,30' is surrounded by an annular section 56. The chamber 30,30' has radial perforations 58 along its entire length. When the valve body 18 is in the open position, the water enters into the apparatus at point A from the water source 14 through the valve body 18. The water exits the valve body 18 entering into the inlet opening 20 of the container 12 with an impinging force normal to the orifice 34,35 orifice adjacent the inlet opening 20. Depending on the chamber 30 or 30' used and the water pressure, a portion of the water penetrates the orifice 34 or 35 entering the chamber 30 or 30' and the residual water flows into the annular section 56 through the radial perforations 58. Moreover, depending on the water pressure and the type of chamber 30 or 30' used, a portion of the solution exits out of the chamber 30 or 30' through the radial perforations 58. The flow through the annular section 56 functions as carrier for the solution exiting the chamber 30 or 30'. This is realized because the annular section 58 offers relatively little restriction to the fluid flow with respect to the chamber 30 or 30'. Once more, dependent on the fluid pressure and the chamber 30 or 30' used, a portion of the solution penetrates the orifice 34' or 35' and mixes with the solution exiting the annular section 56 through the radial perforations 58. The flow of the solution exits through the outlet opening 32 in the cap 36 to the discharge device 16 in the direction B.

The dispenser 10 is quite easy to use. The user may simply fill the chamber 30, 30' by removing the cap 36. With the cap 36 removed, the user may insert the selected chamber 30,30' based on the soluble substance 50 used and the level of concentration desired. With the chamber 30,30' selected and filled with soluble substance 50, the user then replaces the cap 36 on the container 12.

Now, the user places the container 12 in line with the water source 14 and the discharge device 16. The user may determine when the chamber 30,30' needs to be refilled by a visually inspecting the chamber 30,30' through the transparent device 10. The device 10 may be refilled by closing the valve 18, removing the cap 36, filling the chamber 30,30', replacing the cap 36, and reopening the valve 18. The water source 14 does not have to be shut off at the main disconnect (not shown).

It is to be understood that the present invention is not limited to the sole embodiment described above, but encompasses any and all embodiments within the scope of the following claims.

I claim:

1. A controllable dispenser for dispensing an aqueous solution comprised of:

a container of integral, one piece construction throughout its length and having a water inlet opening and a solution outlet opening, means for connecting said inlet to a source of water and a means for connecting said outlet to a solution discharge device, valve means directly adjacent said water inlet opening to control water entering into said inlet opening, a centrally disposed perforated chamber within said container having two ends longitudinally communicating with said inlet opening at one end and said outlet opening at the other end, said chamber holding soluble material, said chamber further having a removable cap disposed adjacent the said other end of said chamber, nearest the outlet opening, whereby said chamber may be filled with a soluble substance, said chamber removable cap further having a depending peripheral skirt fitted over said chamber other end, an intermediate passage defined by an inner surface of said container and an outer surface of said chamber, access means to said chamber to fill said chamber with a soluble material, said access means comprising a removable threaded cap mated to a corresponding threaded portion of said container, said chamber removable cap having an upper end interfitted concentrically within said access means removable threaded cap, and at least two orifices disposed within said chamber, one orifice adjacent the end nearest the inlet opening and one orifice adjacent the end nearest the outlet opening and being located within said chamber removable cap, adjacent said chamber other end, to offer a regulated fluid flow to communicate with said chamber and said passage, whereby said source of water enters through said valve body into said container, a portion of said water enters through said orifice adjacent said inlet opening and a portion enters into said passage, said flow is then permitted to exit said chamber through said perforations and enter into said passage, said flow is finally permitted to exit said chamber through said orifice adjacent said outlet opening and is permitted to mix with said flow exiting said passage adjacent said outlet opening to said discharge device.

2. The dispenser as defined in claim 1, wherein said container and said chamber are constructed of a transparent material.

3. The dispenser as defined in claim 1, including a threaded means adjacent said outlet opening to mate with said discharge device having a corresponding threaded means.

4. The dispenser as defined in claim 1, including a threaded means adjacent said inlet opening to mate with said water source having a corresponding threaded means.

5. The dispenser as defined in claim 1, wherein said chamber is interchangeable with other chambers, each of said chambers having a different diameter and different size orifices which provide varyious restrictions to said flow entering into said container, whereby varying the level of concentration.

* * * * *